US006237229B1

(12) United States Patent
Igawa et al.

(10) Patent No.: US 6,237,229 B1
(45) Date of Patent: May 29, 2001

(54) CHAIN SAW GUIDE BAR WITH CHAIN-TIGHTENING DEVICE

(75) Inventors: Hayato Igawa, Tokyo; Hiromi Okochi, Kanagawa; Akinori Iizuka, Tokyo, all of (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 09/431,708

(22) Filed: Nov. 1, 1999

(30) Foreign Application Priority Data

Nov. 5, 1998 (JP) ..... 10-314611

(51) Int. Cl.[7] ..... B27B 17/14
(52) U.S. Cl. ..... 30/386; 30/383
(58) Field of Search ..... 30/381, 383, 385, 30/386

(56) References Cited

U.S. PATENT DOCUMENTS

| | | | | |
|---|---|---|---|---|
| 2,316,997 | | 4/1943 | Smith | 30/385 |
| 2,532,981 | | 12/1950 | Wolfe | 30/385 |
| 5,177,871 | * | 1/1993 | Martenson | 30/386 |
| 5,345,686 | | 9/1994 | Zimmermann | 30/386 |
| 5,353,506 | * | 10/1994 | Muller et al. | 30/386 |
| 5,528,835 | * | 6/1996 | Ra | 30/386 |
| 6,049,986 | * | 4/2000 | Calkins et al. | 30/386 |

FOREIGN PATENT DOCUMENTS

| | | |
|---|---|---|
| 61-93201 | 6/1986 | (JP) . |
| 5-18090 | 5/1993 | (JP) . |
| 7-314402 | 12/1995 | (JP) . |

* cited by examiner

*Primary Examiner*—H. Payer
(74) *Attorney, Agent, or Firm*—Baker Botts L.L.P.

(57) ABSTRACT

A chain saw guide bar has a pair of elongated chain guide plates, which are superimposed with each other and receive a saw chain. Positioning slots extend in the longitudinal direction of the guide plates and receive a pair of fixing stud bolts that project from the main body of the chain saw. A chain-tightening device, which is incorporated into the guide bar, includes a pulley carried by the guide plates in a fixed position distally of the guide slots. One end of a flexible wire is connected to the pulley. The other end of the flexible wire is connected to a circular ring that is slidably received between the guide plates with an opening thereof at least partly registering with the positioning slots. The ring is received on one of the fixing stud bolts. An intermediate portion of the wire is turned partway around a returning member that is stationarily located on a portion of the guide bar proximally of the fixing stud bolt that receives the ring. Upon rotation of the pulley, part of the wire is wound onto the pulley, thus shortening the length of the cable between the pulley and the stud bolt. The cable acts on the returning member and shifts the guide bar distally relative to the stud bolt and thus relative to the main body.

3 Claims, 5 Drawing Sheets

CHAIN SAW GUIDE BAR WITH CHAIN-TIGHTENING DEVICE

BACKGROUND OF THE INVENTION

The present invention relates to a guide bar for a chain saw of the type used, for example, for cutting down or trimming trees and, in particular, to a guide bar that incorporates a chain-tightening device which enables a user to readily and easily adjust the tightness of the saw chain.

Generally, when a chain saw is employed for a long period of time, the saw chain is caused to elongate due to the abrasion of the portions of the saw chain that engage the guide bar, thus loosening the saw chain and sometimes allowing disengagement of the saw chain from the driving chain sprocket wheel or the guide bar. Therefore, the saw chain is required to be re-tightened occasionally. Further, it is also required at the occasion of exchanging the saw chain for a new one to adjust the tightness of the new saw chain after the new saw chain is mounted on the driving chain sprocket wheel and guide bar.

Chain-tightening devices for adjusting the tightness of the saw chain have been conventionally provided on the main body and side guard of the chain saw. Examples of such a chain-tightening devices are described and shown in Japanese Utility Model Unexamined Publication S61-93201 and Japanese Patent Unexamined Publication H7-314402.

It is required, for the provision of the conventional chain-tightening device, to separately attach accessories to the main body and side guard of the chain saw and to configure the main body and side guard for mounting the chain-tightening device on the chain saw, thus making the chain saw complicated in construction, increasing the number of parts required for the provision of the chain-tightening device, and adding to the costs for manufacturing the chain saw. In addition, the maintenance and inspection of the chain-tightening device can be troublesome, and the chain-tightening device cannot be attached to an existing chain saw.

Additionally, since the conventional chain-tightening device is generally mounted on the main body and side guard of the chain saw, the tightening of the chain is required to be conducted by turning adjustment screws attached to the chain-tightening device using a tool such as a screwdriver. In this case, the adjustment screws are inevitably mounted close to one side wall of the main body of chain saw (generally, the right side wall as viewed from the proximal end of the chain saw), so that the operator is required, for the purpose of turning the adjustment screws, to manipulate a tool such as a screwdriver by directing it in the longitudinal direction of the main body of chain saw, in the direction perpendicular to the main body of chain saw, or in an intermediate direction thereof (or in an oblique direction) so as to position the tool to engage with the adjustment screw members. This often means that the operability for adjusting the tightness of saw chain is inferior and at the same time, it is difficult to confirm the degree of tightness of the saw chain while turning the adjustment screw members, thus making the adjustment of the chain tension rather difficult.

BRIEF SUMMARY OF THE INVENTION

The present invention has been made to overcome the aforementioned problems, and therefore an object of the present invention is to provide a guide bar of chain saw that incorporates a chain-tightening device, which makes it possible to avoid having to separately attach accessories to the main body and side guard of the chain saw or to configure the main body and side guard for mounting the chain-tightening device on the chain saw, thereby simplifying the construction of the chain saw and permitting the number of parts required for the provision of the chain-tightening device to be reduced, thus resulting in savings in manufacturing costs for the provision of the chain-tightening device and in the simplification of not only the assembling, but also the maintenance and inspection of the chain-tightening device. Another object of the present invention is to provide a guide bar of chain saw, which makes it possible to provide an existing chain saw with a chain-tightening function without requiring a modification of the chain saw. Yet another object is to enable a user to readily and easily perform the chain-tightening operation.

With a view to attaining the aforementioned objects, the present invention provides a chain saw guide bar that incorporates a chain-tightening device. A guide bar, according to the present invention, has a pair of elongated chain guide plates, which are superimposed with each other, which have proximal ends and distal ends, and which are adapted to receive a saw chain along portions of the peripheries thereof. Positioning slots formed adjacent the proximal ends of the chain guide plates extend in the longitudinal direction of the guide plates and are adapted to receive a pair of fixing stud bolts that project from the main body of the chain saw. A chain-tightening device carried by the guide bar includes an adjusting winding member carried by the guide plates in a fixed position distally of the guide slots for rotation about an axis. One end of a flexible wire is connected to the adjusting winding member. The other end of the flexible wire is connected to a circular ring that is slidably received between the guide plates with an opening thereof at least partly registering with the positioning slots. The ring is adapted to be received on one of the fixing stud bolts. A returning member is windingly engaged with an intermediate portion of the wire and stationarily located on a portion of the guide bar proximally of said one of the fixing stud bolts.

In a preferred embodiment of the present invention, an intermediate plate is fixedly interposed between and is engaged with the pair of guide plates and forms a space between the guide plates.

An advantageous embodiment of the present invention has a winding member in the form of a pulley having a barrel portion rotatably received in mounting holes formed in the guide plates and a flange portion radially projecting from the barrel portion and received for rotation in the space between the guide plates so as to be retained in the space by engagement with portions of the guide plates surrounding the mounting holes.

At the time of initially attaching the guide bar to the main body of the chain saw, the circular ring is at first fitted around the fixing stud bolt that projects from the main body of the chain saw. Then, for the purpose of fitting the saw chain around the guide bar, the guide bar is at first positioned on the main body of chain saw slightly rearwardly of the location that it occupies when the saw chain is in place and tightened for use.

Next, the saw chain is fitted around the driving sprocket that is connected with the drive motor inside the main body of chain saw and also around the guide plates of the guide bar. Thereafter, the side guard is set in position, and the fastening screws are hand-tightened onto the fixing stud bolts, thereby allowing the guide bar to be moved by the chain-tightening device in the longitudinal direction distally of the main body of the chain saw.

At this point, the adjusting winding member is turned clockwise by making use of a screw driver so as to adjust the tension of the saw chain. An end portion of the flexible wire is thereupon wound onto the adjusting winding member. Since the other end portion of the flexible wire is fixed by the circular ring to the fixing stud bolt and the intermediate portion of the flexible wire is wrapped around the turning member, the winding of the flexible wire onto the adjusting pulley causes the guide bar to move distally in a direction away from the main body of chain saw by a distance corresponding to half of the length of the flexible wire that is wound onto the adjusting pulley, the turning member serving as a working point for application of a force from the wire to the guide bar.

When the guide bar is moved distally in this manner, the distance between the driving sprocket of the main body of chain saw around which the saw chain is wound and the tip end portion of the guide bar is enlarged, so that the slack in the saw chain is removed and the chain is tightened.

After the saw chain is suitably tightened through the turning of the adjusting winding member, the fastening nuts are fully tightened on studs so that the guide bar is firmly fixed to the chain saw body, thus finishing the tightening of the saw chain.

A chain saw guide bar according to the present invention incorporates a chain-tightening device of simple structure, which is essentially composed of the adjusting winding member, the flexible wire, the returning member, and the circular ring. It is now possible to obviate any requirement to separately attach accessories to the main body or side guard of the chain saw or to configure the main body or side guard for mounting the chain-tightening device on the chain saw, thereby simplifying the construction of the chain saw and enabling a reduction in the number of parts required for the provision of the chain-tightening device. Savings in the cost of manufacturing for the provision of the chain-tightening device are derived not only from the simplification of the parts but in the assembling, maintenance and inspection of the chain-tightening device. At the same time, it is now possible to easily and reasonably provide an existing chain saw that lacks a chain-tensioning device with a chain-tightening function without requiring a modification of the chain saw.

Further, since the guide bar is provided with the adjusting winding member in place of the adjusting screw member of the conventional chain saw, it is now possible for an operator, in the adjustment of the tightness of the saw chain, to manipulate a tool such as a screwdriver from the direction of the sidewall (generally, the right side wall) of the guide bar, which affords a sufficient space for the manipulation of the tool and to easily confirm the tightened degree of the saw chain, thus allowing the tool to be readily engaged with and to turn the adjusting winding member. As a result, the chain-tightening operation can be readily and easily performed with a high precision.

DESCRIPTION OF THE DRAWINGS

For a more complete understanding of the present invention, and the advantages thereof, reference may be made to the following written description of an exemplary embodiment, taken in conjunction with the accompanying drawings.

DESCRIPTION OF THE EMBODIMENT

Figure 1:
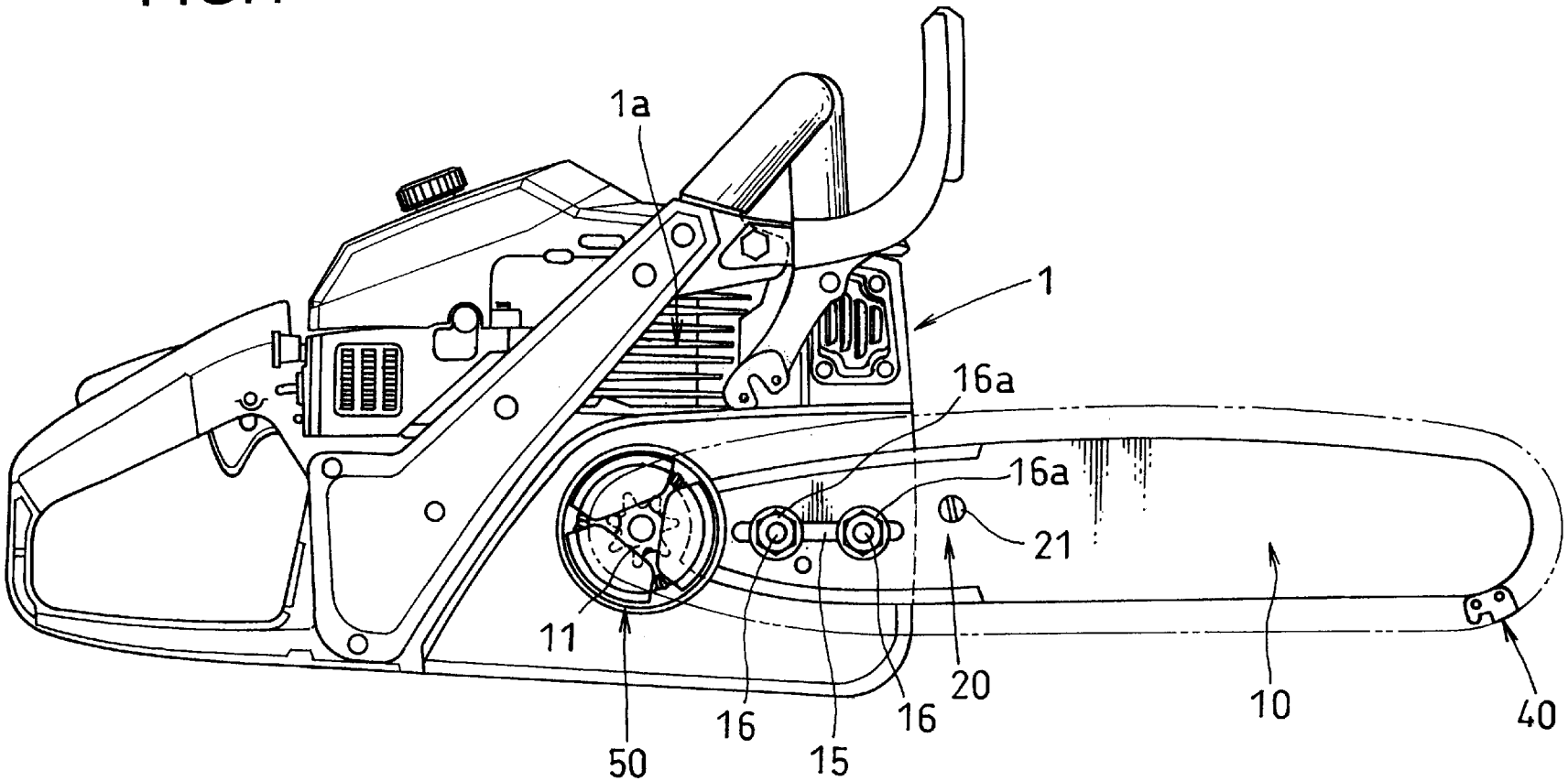
FIG. 1 is a right side elevational view of an entire chain saw that is provided with a chain-tightening device incorporated into the chain guide bar, according to one embodiment of the present invention (side guard is removed)
Figure 2:
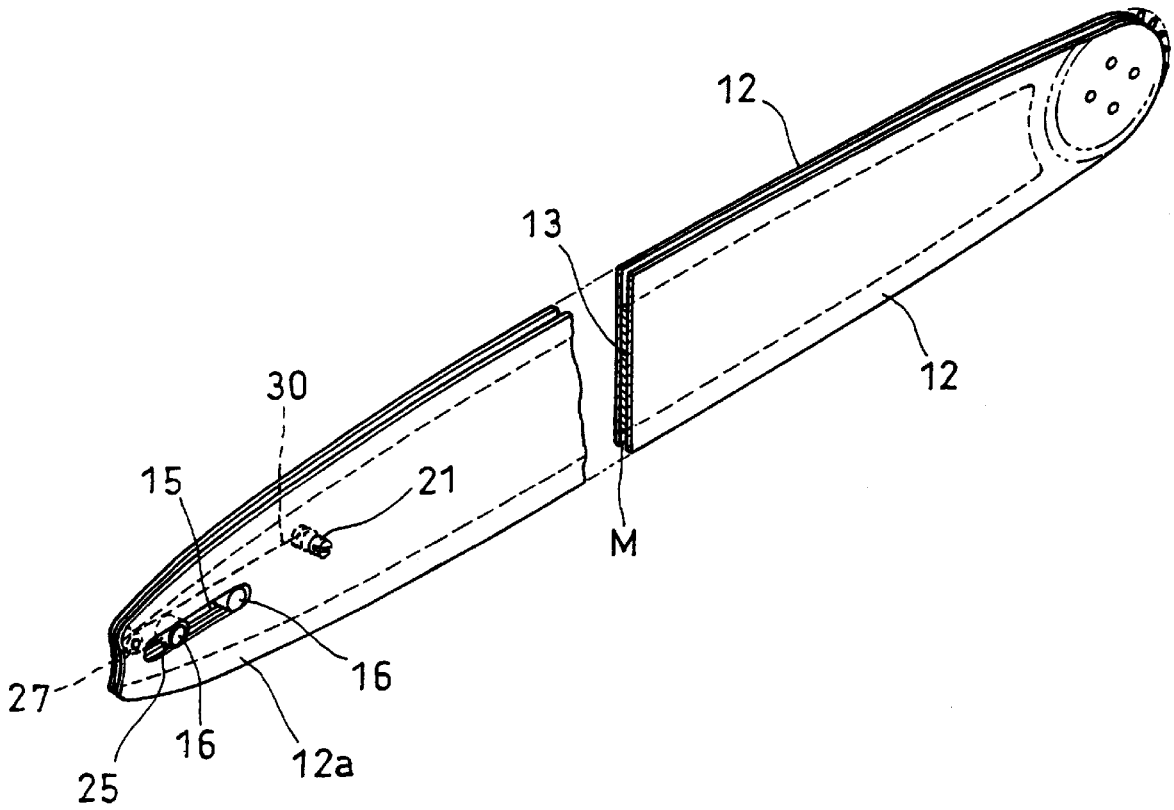
FIG. 2 is an enlarged perspective view of the guide bar of the chain saw shown in FIG. 1.

As shown in FIG. 1, the chain saw is composed of a main body 1 and a guide bar 10. The main body 1 has a drive motor 1*a* such as an internal combustion engine that is coupled via a centrifugal clutch 50 to and drives a driving sprocket 11 and the guide bar 10 that is attached to the main body 1 and carries an endless saw chain 40, which is fitted around the major part of the periphery of the guide bar 10.

The guide bar has a positioning slot 15, which extends longitudinally along the guide bar 10 and receives a pair of fixing stud bolts 16 that extend outwardly from the main body 1 and receive nuts 16*a* that clamp the guide bar 10 to the main body 1. When the driving sprocket 11 is driven by the motor 1*a*, the saw chain 40 is caused to run along the periphery of the guide bar 10.

The guide bar 10 comprises a pair of (right and left) steel guide plates 12, which are superimposed with each other and the peripheries of which are configured to be engaged with the saw chain 40, a steel intermediate plate 13 having a smaller size than that of the guide plates 12, and a groove M formed along the outer periphery of the intermediate plate 13 for guiding the saw chain 40.

Figure 3:
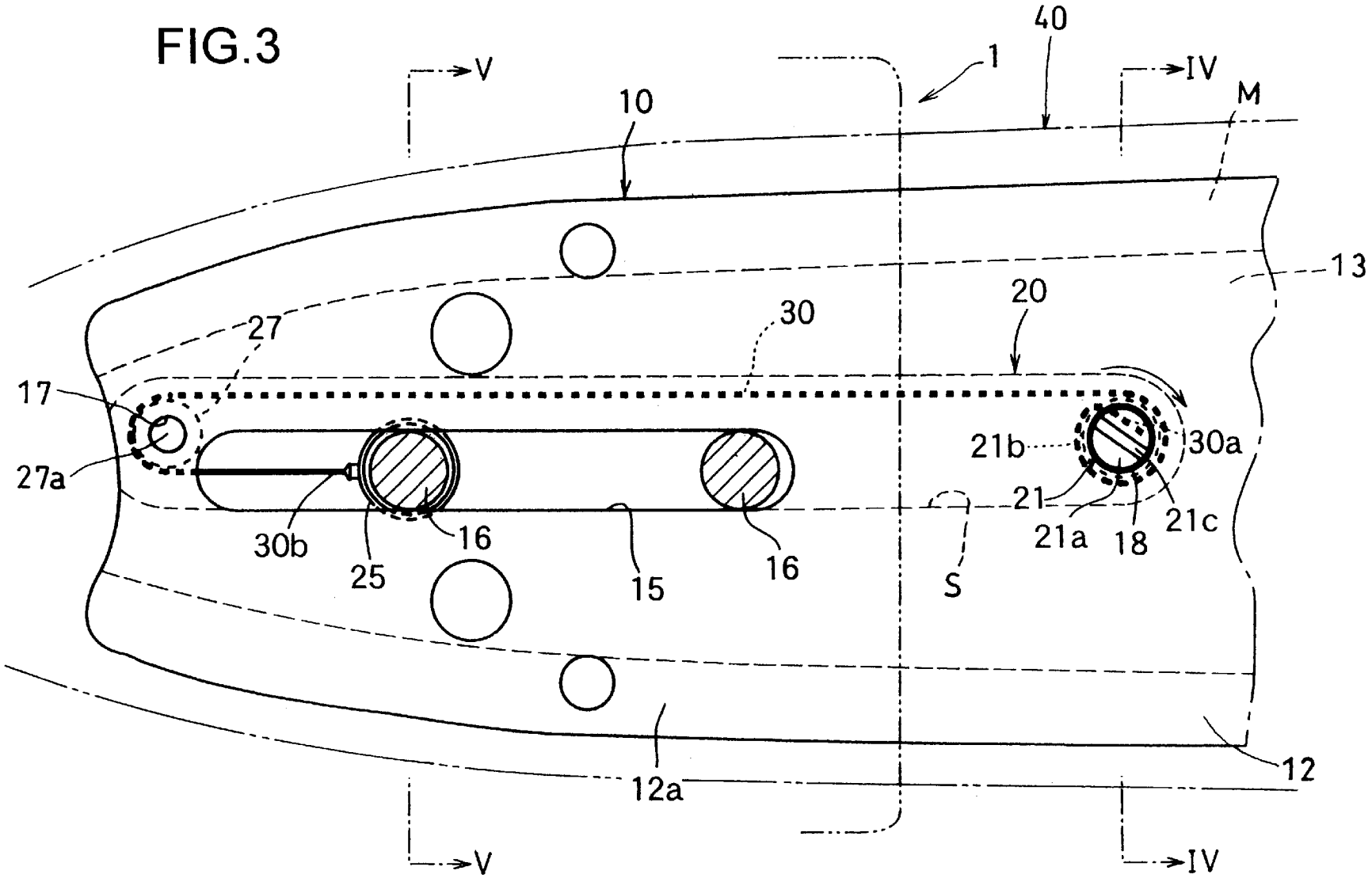
FIG. 3 is a right side elevational view of the proximal portion of the guide bar, where the chain-tightening device is located.

The guide plates 12 are respectively provided, at the proximal attachment portion 12*a* thereof that is located at the right side wall portion of the main body 1 of the chain saw (the forward end of the main body 1 is shown by a phantom line in FIG. 3), with the positioning slot 15 that extends longitudinally of the guide plates 12 and through which the shanks of the fixing stud bolts 16 extend.

Figure 4:
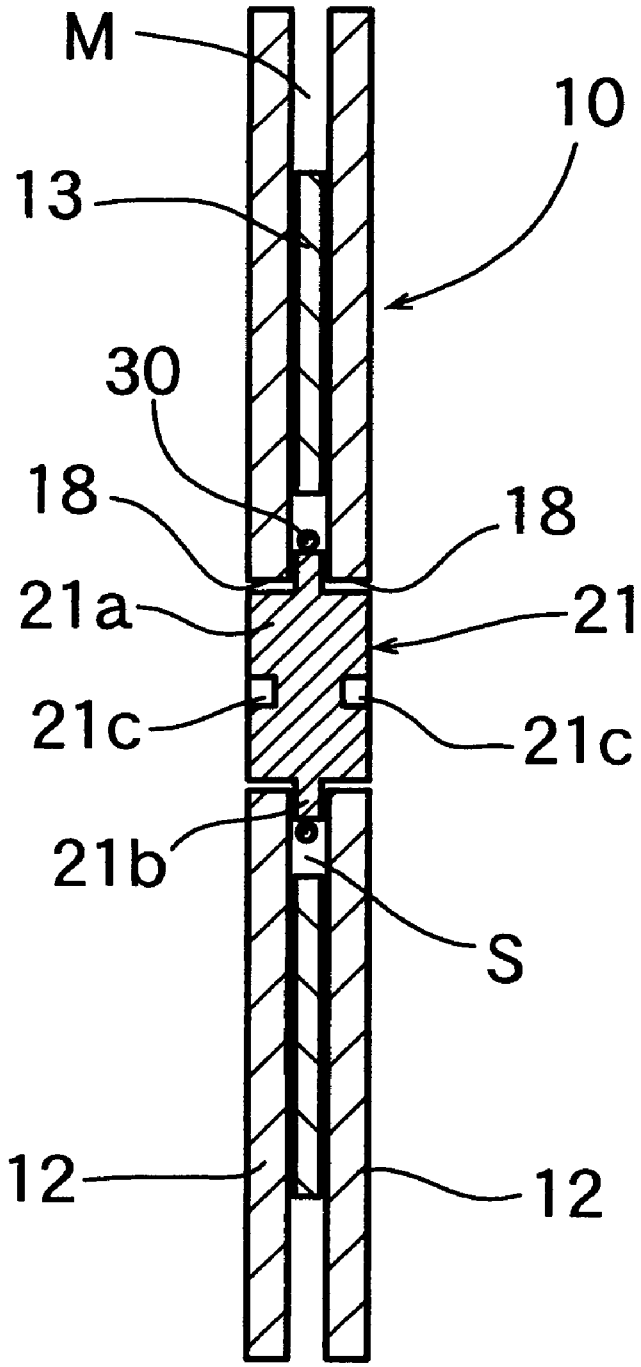
FIG. 4 is an enlarged cross-sectional view taken along the line IV—IV of FIG. 3.
Figure 5:
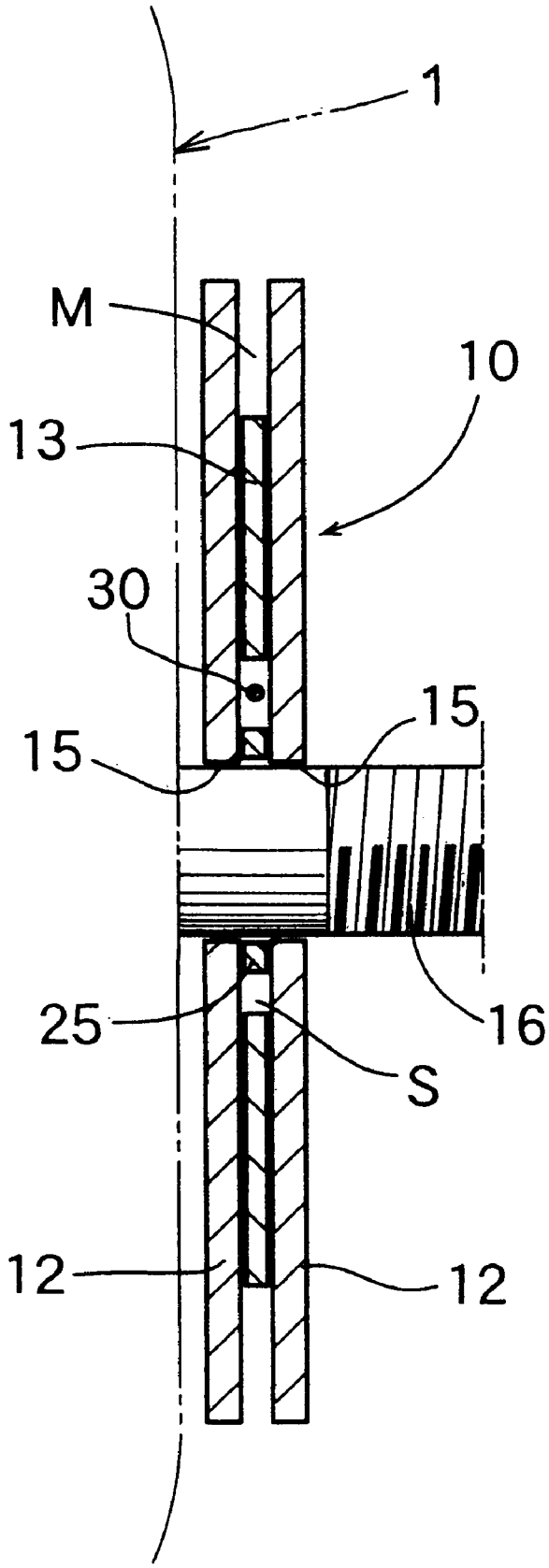
FIG. 5 is an enlarged cross-sectional view taken along the line V—V of FIG. 3.

The proximal portion of the chain guide bar 10 incorporates a chain-tightening device 20, the components of which are accepted in a slot S in the intermediate plate 13 that is wider and longer than the slots 15 in the guide plates 12 (see FIG. 3). An adjusting pulley 21 functioning as an adjusting winding member for adjusting the tightness of the saw chain 40 is stationarily (in position) and rotatably attached to a portion of the guide plates 12 which is located forwardly (distally) of the distal end of main body 1 of chain saw. The adjusting pulley 21 is composed of a barrel portion 21*a* that is received with a sliding fit in mounting holes 18 formed respectively in the guide plates 12 and a flange portion 21*b* that projects radially from the barrel portion 21*a* and is received in the slot S (see FIG. 4) and corresponds in thickness of the intermediate plate 13 interposed between the guide plates 12, thereby allowing the flange portion 21*b* to be rotatably held in captured, sandwiched relation by portions of the plates 12 surrounding the mounting holes 18. The barrel portion 21*a* is further provided on both end faces thereof with slots 21*c* that can be engaged by the blade of a screw driver for rotating the adjusting pulley 21.

The adjusting pulley 21 is connected via a fastening hole formed therein, for instance, with one end portion 30*a* of a flexible wire 30 such as by means of soldering. The other end 30*b* of the flexible wire 30 is connected by a suitable means with a circular ring 25 having an inner diameter larger than not only the outer diameter of the fixing stud bolt 16 but also the width of the positioning slot 15, the circular ring 25 being made slidable within the slot S of the intermediate plate 13 and along the margins of the positioning slot 15 and being adapted to be fitted over the fixing stud bolt 16.

A turning pin 27 functioning as a returning member around which an intermediate portion of the wire 30 is wrapped through about 180 degrees is stationarily (in position) disposed at a portion of the guide plates 12 which is located proximally of the rear fixing stud bolt 16 and near the rear end of the positioning slot 15. This turning pin 27 may be made rotatable just like a pulley by providing the guide plates 12 with bearing holes 17, respectively, and by fitting both outer end shaft portions 27*a* of the turning pin 27 into the bearing holes 17. The body of the turning pin 27 is received in the slot S of the intermediate plate 13 and is sandwiched between the guide plates 12.

When the guide bar 10 is initially attached to the main body 1 of the chain saw, the circular ring 25 is at first fitted around the rearward fixing stud bolt 16. Then, for the purpose of fitting the saw chain 40 around the guide bar 10, the guide bar 10 is at first positioned slightly rearward with respect to the main body 1 as compared with the location it occupies when installed in the tightened position for use of the chain saw.

Then, the saw chain 40 is placed on the driving sprocket 11. Thereafter, the side guard (not shown) of known construction is set in position, and the fastening nuts 16*a* are hand-tightened onto the fixing stud bolts 16, thereby allowing the guide bar 10 to be moved in the longitudinal direction thereof by the chain-tightening device 20.

At this point, since the saw chain 40 is still in a slackened state for the purpose of fitting it to the guide bar 10, the adjusting pulley 21 is turned clockwise by a screw driver so as to tighten the saw chain 40. Upon turning of the adjusting pulley 21, part of the wire 30 adjacent the end portion 30*a* which is connected with the adjusting pulley 21 is wound around the adjusting pulley 21. Since the other end portion 30*b* of the wire 30 is fixed by the circular ring 25 to the fixing stud bolt 16 with the intermediate portion of the wire 30 being reversed in direction by turning over the turning pin 27, when part of the wire 30 is wound around the adjusting pulley 21, the guide bar 10 is caused to move in the distal direction away from the main body 1 of the chain saw by a distance corresponding to a half of the wound length of the wire 30 with the turning pin 27 being acting upon as a working point by the wire 30.

When the guide bar 10 is moved distally, the distance between the driving sprocket 11 of the main body 1 of chain saw with which the saw chain 40 is engaged and the distal end portion of the guide bar 10 is increased, so that the slack in the saw chain 40 is removed and the saw chain tightened. After the desired tightness of the saw chain 40 is attained by the turning of the adjusting pulley 21, the fastening nuts 16*a* are fully tightened on the studs 16 to firmly clamp the guide bar 10 in the adjusted position, thus completing the set-up of the chain saw for normal use.

With the guide bar 10 of the above-described embodiment, since the guide bar 10 incorporates a chain-tightening device 20 of simple structure which essentially consists of the adjusting pulley 21 functioning as an adjusting winding member, the wire 30, the turning pin 27 functioning as a returning member, and the circular ring 25, it is now possible to obviate any requirement to separately attach accessories to the main body or side guard of the chain saw or to configure the main body or side guard for mounting a chain-tightening device on the chain saw, thereby simplifying the construction of the chain saw, enabling a reduction in the number of parts required for the provision of the chain-tightening device, resulting in the savings of manufacturing and assembly costs for the provision of the chain-tightening device, and simplifying the maintenance and inspection of the chain-tightening device. At the same time, it is now possible to provide an existing chain saw with a chain-tightening function without requiring a modification of the chain saw.

Further, since the guide bar is provided with the adjusting pulley 21 functioning as an adjusting winding member in place of the adjusting screw member of the conventional chain saw, it is now possible for an operator, in the adjustment of the tightening of saw chain, to manipulate a tool such as a screw driver from the direction of the side wall (generally, the right side wall) of the guide bar which affords a sufficient space for the manipulation of the tool and to easily confirm the tightness of the saw chain, thus allowing the tool to be readily engaged with the screw driver slots 21*c* of the adjusting pulley 21 and to turn the adjusting pulley 21. As a result, the chain-tightening operation can be readily and easily performed with a high precision.

While in the foregoing one embodiment of the present invention has been explained in detail for the purpose of illustration, it will be understood that the construction of the device can be varied without departing from the spirit and scope of the invention as claimed in the following claims.

What is claimed is:

1. A chain saw guide bar, comprising a pair of elongated chain guide plates which are superimposed with each other, which have proximal ends and distal ends, and which are adapted to receive a saw chain along portions of the peripheries thereof;

positioning slots formed adjacent the proximal ends of the chain guide plates that extend in the longitudinal direction of the guide plates and that are adapted to receive a pair of fixing stud bolts that project from a main body of a chain saw; and a chain-tightening device carried by the guide bar and including an adjusting winding member carried by the guide plates in a fixed position distally of the positioning slots for rotation about an axis, a flexible wire, one end of which is connected with the adjusting winding member, a circular ring connected with the other end of the flexible wire, slidably received between the guide plates with an opening thereof at least partly registering with the positioning slots, and adapted to be received on one of the fixing stud bolts, and a returning member windingly engaged with an intermediate portion of the wire and stationarily located on a portion of the guide bar proximally of said one of the fixing stud bolts.

2. The guide bar according to claim 1, and further comprising an intermediate plate which is fixedly interposed between and is engaged with the pair of guide plates and forms a space between the guide plates.

3. The guide bar according to claim 2, wherein the adjusting winding member is a pulley having a barrel portion rotatably received in mounting holes formed in the guide plates and a flange portion radially projecting from the barrel portion and received for rotation in the space so as to be retained in the space by engagement with portions of the guide plates surrounding the mounting holes.

* * * * *